US006244226B1

(12) United States Patent
Berlinger et al.

(10) Patent No.: US 6,244,226 B1
(45) Date of Patent: Jun. 12, 2001

(54) FREE PISTON INTERNAL COMBUSTION ENGINE WITH ROTATING PISTON

(75) Inventors: Willibald G. Berlinger, Peoria; Francis J. Raab, Chillicothe; John M. Sloma, Lacon, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/369,610

(22) Filed: Aug. 6, 1999

(51) Int. Cl.[7] ..... F02B 71/00

(52) U.S. Cl. ..... 123/46 R; 123/46 SC; 123/193.4

(58) Field of Search ..... 123/46 SC, 46 R, 123/193.4

(56) References Cited

U.S. PATENT DOCUMENTS

| | | | | |
|---|---|---|---|---|
| 2,995,122 | | 8/1961 | Randall . | |
| 3,044,452 | * | 7/1962 | McCrory et al. | 123/46 SC |
| 3,606,591 | * | 9/1971 | Fotma | 123/46 SC |
| 3,610,217 | * | 10/1971 | Braun | 123/46 SC |
| 4,705,460 | * | 11/1987 | Braun | 123/46 SC |
| 5,473,893 | * | 12/1995 | Acten et al. | 123/46 SC |
| 5,482,445 | * | 1/1996 | Acten et al. | 123/46 SC |
| 6,105,541 | * | 8/2000 | Berlinger | 123/46 SC |

FOREIGN PATENT DOCUMENTS

| | | |
|---|---|---|
| 0 065 171 | 11/1982 | (EP) . |
| WO 00/50756 | 8/2000 | (WO) . |

OTHER PUBLICATIONS

TU Dresden—publication date unknown—earliest 1993 Dresden University in Germany.

* cited by examiner

*Primary Examiner*—Marguerite McMahon
*Assistant Examiner*—Jason Benton
(74) *Attorney, Agent, or Firm*—Taylor & Aust, P.C.

(57) ABSTRACT

A free piston internal combustion engine includes a housing with a combustion cylinder and a second cylinder. A piston includes a piston head reciprocally disposed within the combustion cylinder; a second head reciprocally disposed within the second cylinder; a plunger rod with a first end attached to the piston head, a second end attached to the second head, and a longitudinal axis; and a plurality of radially extending vanes attached to the plunger rod and the second head. The radially extending vanes face toward the piston head and are disposed at an acute angle relative to the longitudinal axis.

13 Claims, 4 Drawing Sheets

FREE PISTON INTERNAL COMBUSTION ENGINE WITH ROTATING PISTON

TECHNICAL FIELD

The present invention relates to free piston internal combustion engines, and, more particularly, to piston and cylinder configurations within such engines.

BACKGROUND ART

Free piston internal combustion engines include one or more pistons which are reciprocally disposed within corresponding combustion cylinders. However, the pistons are not interconnected with each other through the use of a crankshaft. Rather, each piston is typically rigidly connected with a plunger rod which is used to provide some type of work output. For example, the plunger rod may be used to provide electrical power output by inducing an electrical current, or fluid power output such as pneumatic or hydraulic power output. In a free piston engine with a hydraulic output, the plunger is used to pump hydraulic fluid which can be used for a particular application. Typically, the housing which defines the combustion cylinder also defines a hydraulic cylinder in which the plunger is disposed and an intermediate compression cylinder between the combustion cylinder and the hydraulic cylinder. The combustion cylinder has the largest inside diameter; the compression cylinder has an inside diameter which is smaller than the combustion cylinder; and the hydraulic cylinder has an inside diameter which is still yet smaller than the compression cylinder. A compression head which is attached to and carried by the plunger at a location between the piston head and plunger head has an outside diameter which is just slightly smaller than the inside diameter of the compression cylinder. A high pressure hydraulic accumulator which is fluidly connected with the hydraulic cylinder is pressurized through the reciprocating movement of the plunger during operation of the free piston engine. An additional hydraulic accumulator is selectively interconnected with the area in the compression cylinder to exert a relatively high axial pressure against the compression head and thereby move the piston head toward the top dead center (TDC) position.

With conventional free piston engines, each piston is reciprocally disposed within a corresponding combustion cylinder, but is not rotated within the combustion cylinder. As the piston moves from a TDC position toward a bottom dead center (BDC) position, the piston head moves past and uncovers the exhaust outlet to allow the combustion products within the combustion chamber to flow therefrom. Since the piston head does not rotate within the combustion cylinder, the same portion of the piston head is continually disposed adjacent to the exhaust outlet. The portion of the piston head adjacent to the exhaust outlet has been found to have higher temperatures when compared with other portions of the piston head (e.g., when compared with the portion of the piston head adjacent to the combustion area inlet associated with the air scavenging channel). These thermal gradients and distortions of the piston head may cause thermal fatigue of the piston head over time, resulting in a decreased life expectancy of the piston head.

The present invention is directed to overcoming one or more of the problems as set forth above.

DISCLOSURE OF THE INVENTION

In one aspect of the invention, a free piston internal combustion engine includes a housing with a combustion cylinder, a second cylinder, and a fluid port disposed in communication with the second cylinder for transporting a pressurized fluid into the second cylinder. A piston within the housing is movable between a top dead center position and a bottom dead center position. The piston includes a piston head reciprocally disposed within the combustion cylinder, a second head reciprocally disposed within the second cylinder, and a plunger rod with a first end attached to the piston head and a second end attached to the second head. A flow impingement device is positioned adjacent to the plunger rod and is attached to the plunger rod and/or second head. The flow impingement device includes a plurality of vanes which cause the piston to rotate upon movement toward the top dead center position.

In another aspect of the invention, a free piston internal combustion engine includes a housing with a combustion cylinder and a second cylinder. A piston includes a piston head reciprocally disposed within the combustion cylinder; a second head reciprocally disposed within the second cylinder; a plunger rod with a first end attached to the piston head, a second end attached to the second head, and a longitudinal axis; and a plurality of radially extending vanes attached to the plunger rod and the second head. The radially extending vanes face toward the piston head and are disposed at an acute angle relative to the longitudinal axis.

BEST MODE FOR CARRYING OUT THE INVENTION

Figure 1:
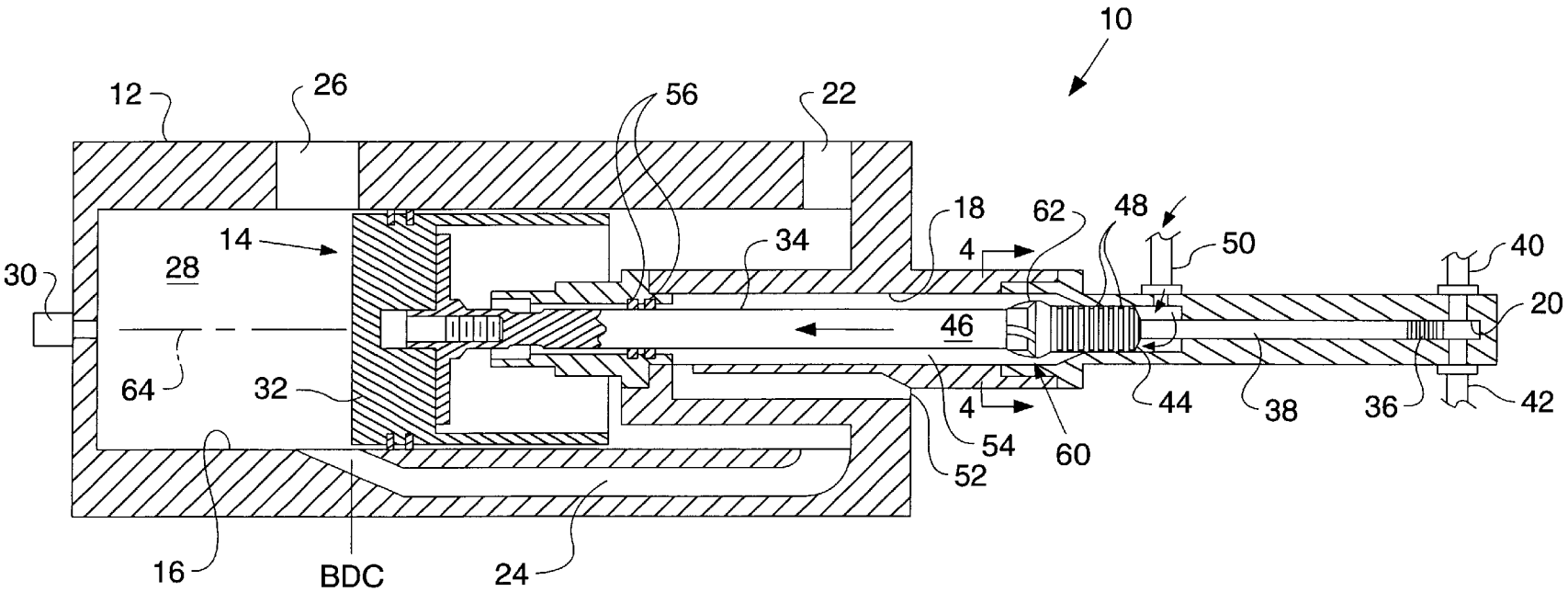
FIG. 1 is a simplified side, sectional view of a portion of a free piston internal combustion engine of the present invention with the piston at a bottom dead center position.

Referring now to the drawings, and more particularly to FIG. 1, there is shown a simplified side, sectional view of an embodiment of a portion of a free piston internal combustion engine 10 including a housing 12 and piston 14.

Housing 12 generally includes a combustion cylinder 16, compression cylinder 18 and hydraulic cylinder 20. Housing 12 also includes a combustion air inlet 22, air scavenging channel 24 and exhaust outlet 26 which are disposed in communication with a combustion chamber 28 within combustion cylinder 16. Combustion air is transported through combustion air inlet 22 and air scavenging channel 24 into combustion chamber 28 when piston 14 is at or near a BDC position. An appropriate fuel, such as a selected grade of diesel fuel, is injected into combustion chamber 28 as piston 14 moves toward a TDC position using a controllable fuel injector system, shown schematically and referenced as 30. The stroke length of piston 14 between a BDC position and a TDC position may be fixed or variable.

Piston 14 is reciprocally disposed within combustion cylinder 28 and generally includes a piston head 32 which is attached to a plunger rod 34. A plunger head 36 is attached to a smaller diameter portion 38 of plunger rod 34 at an end generally opposite from piston head 32. Hydraulic cylinder 20 is disposed in communication with each of an inlet port 40 and an outlet port 42 in housing 12. Reciprocating movement of plunger head 36 within hydraulic cylinder 20 causes hydraulic fluid to be drawn into hydraulic cylinder 20 through inlet port 40 from a source of hydraulic fluid, such as a low pressure hydraulic accumulator (not shown), on a compression stroke of piston 14; and causes pressurized hydraulic fluid to be discharged from outlet port 42 to a high pressure hydraulic accumulator (not shown) on a return stroke of piston 14.

A compression head 44 is disposed between piston head 32 and plunger head 36, and interconnects smaller diameter portion 38 with a larger diameter portion 46 of plunger rod 34. Reciprocating movement of piston head 32 between a BDC position and a TDC position, and vice versa, causes corresponding reciprocating motion of compression head 44 within compression cylinder 18. Compression head 44 includes a plurality of sequentially adjacent lands and valleys 48 which effectively seal with and reduce friction between compression head 44 and an inside surface of compression cylinder 18. Compression cylinder 18 is disposed in communication with fluid ports 50 and 52 generally at opposite ends thereof. Pressurized fluid which is transported into compression cylinder 18 on a side of compression head 44 adjacent to fluid port 50 causes piston 14 to move toward a TDC position during a compression stroke. Conversely, pressurized fluid may be transported through fluid port 52 into compression cylinder 18 in an annular space 54 surrounding larger diameter portion 46 to effect a return stroke of piston 14 at the initial start up or upon the occurrence of a is fire.

Combustion cylinder 16 is separated from compression cylinder 18 using at least one annular bearing/seal 56 which surrounds larger diameter portion 46 of plunger rod 34. Bearing/seal 56 allows sliding movement of larger diameter portion 46 therethrough, while at the same time supporting larger diameter portion 46 in a radial direction. Similarly, compression cylinder 18 may be separated from hydraulic cylinder 20 using an annular bearing/seal (not shown) allowing sliding movement of smaller diameter portion 38 of plunger rod 34, while at the same time radially supporting smaller diameter portion 38.

Figure 2:
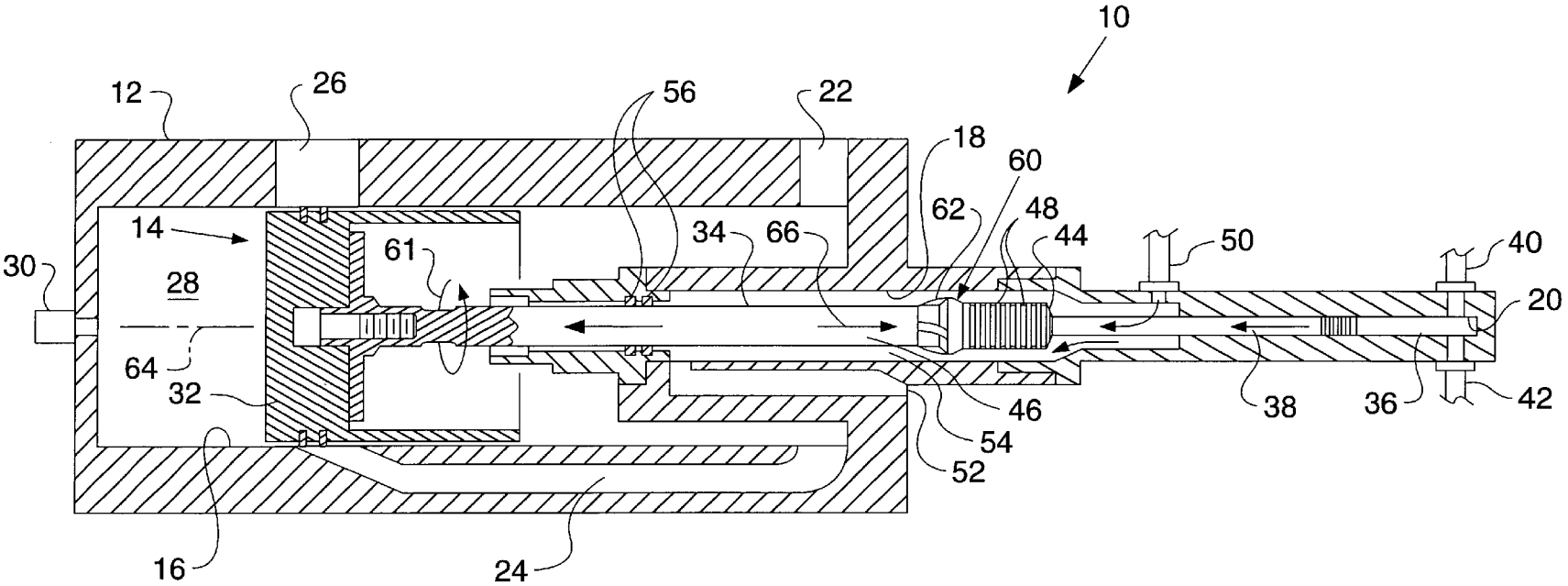
FIG. 2 is a simplified side, sectional view of the free piston internal combustion engine of FIG. 1, with the piston between a bottom dead center position and a top dead center position.

According to an aspect of the present invention, piston 14 is provided with a flow impingement device 60, the fluid within compression cylinder 18 impinging upon flow impingement device 60, as best shown in FIG. 2, when piston 14 moves from a BDC to a TDC position during a compression stroke. Fluid within compression cylinder 18 which impinges upon flow impingement device 60 (as indicated by arrow 66) causes piston 14 to rotate (as shown by arrow labeled as 61) during the compression stroke of piston 14.

More particularly, flow impingement device 60 has a diameter which is larger than compression head 44 and includes a plurality of radially extending vanes 62 which face toward piston head 32 and are adjacent to larger diameter portion 46 of plunger rod 34. Vanes 62 do not extend toward or face compression head 44. Rather, the portion of flow impingement device 60 adjacent compression head 44 is substantially annular shaped with a smooth surface which allows the fluid within compression cylinder 18 to merely flow past flow impingement device 60 when piston 14 moves from a TDC position to a BDC position during a return stroke. Thus, rotation of piston 14 only occurs during a compression stroke of piston 14. This allows the rotation of piston 14 to increment or step during successive cycles of piston 14, thereby ensuring that different parts of piston head 32 are exposed to the higher temperature exhaust gases which exit through exhaust outlet 26.

Figure 4:
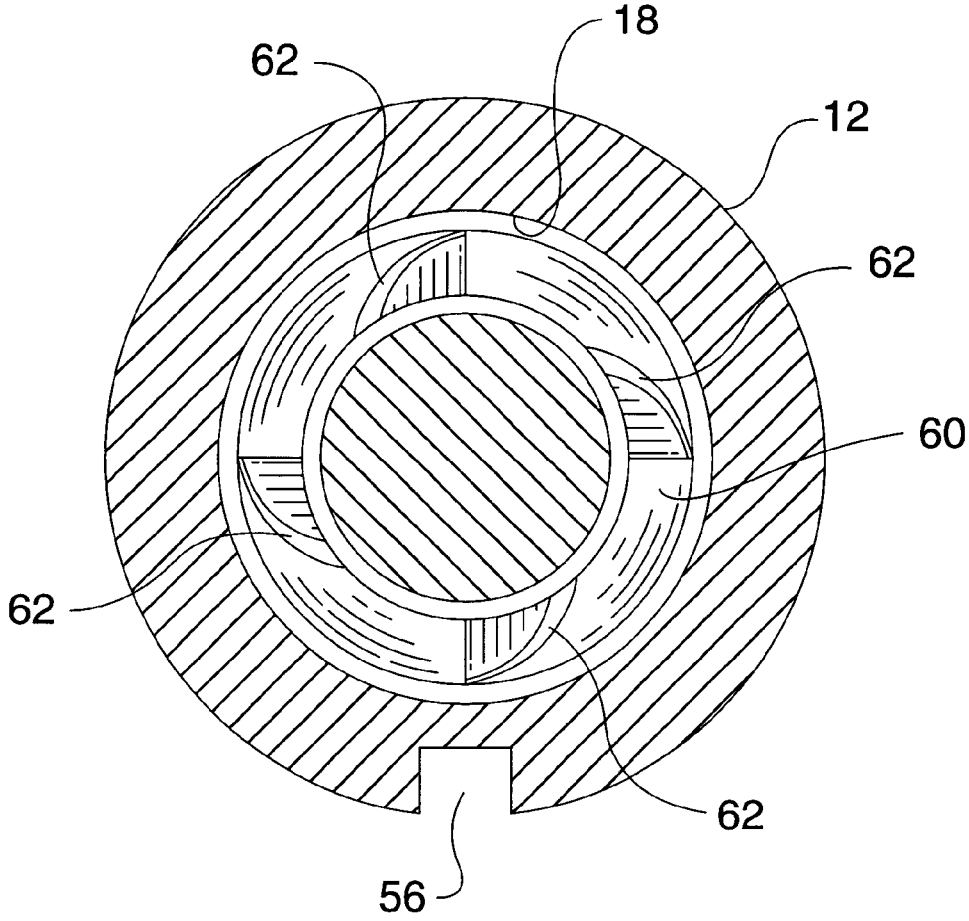
FIG. 4 is a sectional view taken along line 2—2 in FIG. 1.

The exact number and geometry of vanes 62 may vary depending upon the specific application of free piston engine 10. In the embodiment shown, flow impingement device 60 includes four vanes 62 which are substantially identically configured with curvilinear edges which are disposed at an acute angle relative to longitudinal axis 64 of plunger rod 34 (FIG. 4). Vanes 62 extend radially from longitudinal axis 64, but are slightly offset from longitudinal axis 64 (FIG. 4). In other embodiments, vanes 62 may be disposed at a different angle relative to longitudinal axis 64; may have a linear profile; and/or may be aligned with longitudinal axis 64 of plunger rod 34. Moreover, vanes 62 may be identically configured or differently configured from one vane to another. It will be appreciated that the specific geometry of vanes 62 may affect the degree of rotation of piston 14 with each piston oscillation and may vary depending upon a specific application.

In the embodiment shown, flow impingement device 60 is integrally configured with each of compression head 44 and larger diameter portion 46. That is, flow impingement device 60 is monolithically formed with each of compression head 44 and larger diameter portion 46. However, it is also possible to configure flow impingement device 60 such that it is only connected with compression head 44 or larger diameter portion 46. Other configurations of flow impingement device 60 are of course also possible.

INDUSTRIAL APPLICABILITY

During use, piston 14 is reciprocally disposed within combustion cylinder 16 and travels between a BDC position and a TDC position during a compression stroke, and between a TDC position and a BDC position during a return stroke. The actual location of the BDC position may vary from one cycle to another. Combustion air is introduced into combustion chamber 28 through combustion air inlet 22 and air scavenging channel 24. Fuel is controllably injected into combustion chamber 28 using a fuel injector 30. When piston 14 is at or near a BDC position, a pulse of pressurized fluid is transported through fluid port 50 into compression cylinder 18 adjacent an end of compression head 44 which is attached to smaller diameter portion 38 of plunger rod 34. The pressurized fluid fills the portion of compression cylinder 18 surrounding smaller diameter portion 38 of plunger rod 34 and causes piston 14 to move toward a TDC position during a compression stroke. When piston 14 is at or near a BDC position (FIG. 1), compression head 44 substantially seals with an inside diameter of compression cylinder 18, thereby allowing the high pressure fluid which is pulsed through fluid port 50 to move piston 14 toward the TDC position. As piston 14 moves away from the BDC position, compression head 44 no longer is in sealing contact with an inside diameter of compression cylinder 18 (FIG. 2). A radial clearance exists between flow impingement device 60 and the inside diameter of compression cylinder 18. This radial clearance allows fluid within compression cylinder 18 to flow past flow impingement device 60 during the compression stroke. As piston 18 moves toward the TDC position, the change in momentum of the fluid within compression cylinder 18 impinges upon vanes 62 and flows past flow impingement device 62 exerts a rotational force against piston 14 as a result of the acute angular relationship between vanes 62 and longitudinal axis 64. The rotational force which is exerted against piston 14 causes piston 14 to rotate to some degree during the compression stroke.

Figure 3:
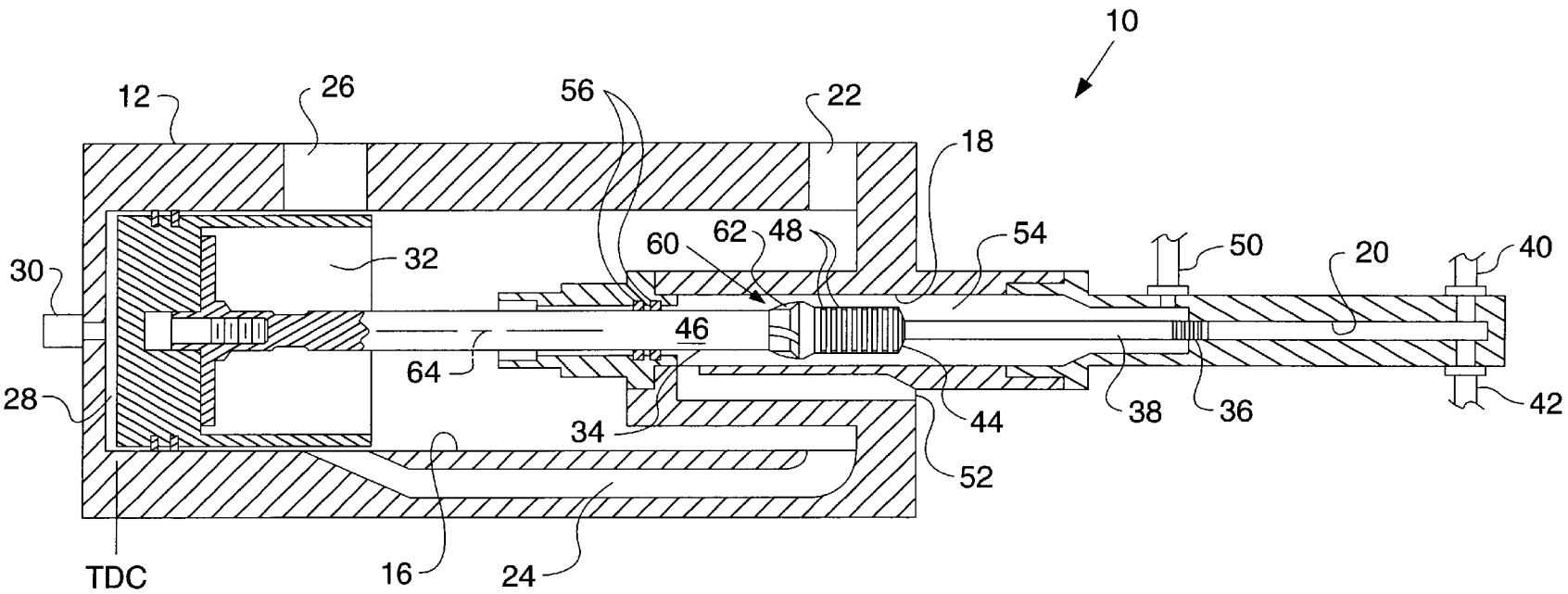
FIG. 3 is a simplified side, sectional view of the free piston internal combustion engine of FIGS. 1 and 2, with the piston at a top dead center position.

When piston 14 is at or near a TDC position (FIG. 3), combustion via compression occurs within combustion chamber 28 and piston 14 moves back toward a BDC position during a return stroke. As piston 14 moves toward a BDC position, fluid within compression cylinder 18 flows over the curved, annular portion of flow impingement device 60 which is adjacent compression head 44. Vanes 62 are thus shielded to some extent from the fluid flow within compression cylinder 18 when piston 14 moves toward a BDC position during a return stroke. Since the fluid merely substantially flows over flow impingement device 60, and does not directly impinge upon vanes 62, piston 14 does not rotate during a return stroke. This ensures that piston 14 rotates in an incremental manner during successive cycles of free piston engine 10.

The present invention causes piston 14 to rotate during use to prevent thermal fatigue of the portion of piston head 32 which is adjacent to exhaust outlet 26. The rotating piston 14 inhibits uneven wear between the piston head 32 and combustion cylinder wall 16. Piston 14 is rotated without requiring additional power input to the system. Piston 14 rotates in an incremental manner which ensures that different portions of piston head 32 are exposed to the higher temperature gases which flow through exhaust outlet 26.

Other aspects, objects and advantages of this invention can be obtained from a study of the drawings, the disclosure and the appended claims.

What is claimed is:

1. A free piston internal combustion engine, comprising:

a housing including a combustion cylinder, a second cylinder, and a fluid port disposed in communication with said second cylinder for transporting a pressurized fluid into said second cylinder; and a piston within said housing which is movable between a top dead center position and a bottom dead center position, said piston including:

a piston head reciprocally disposed within said combustion cylinder;

a second head reciprocally disposed within said second cylinder;

a plunger rod with a first end attached to said piston head and a second end attached to said second head; and a flow impingement device adjacent said plunger rod and attached to at least one of said plunger rod and said second head, said flow impingement device including a smooth, substantially annular portion and a plurality of vanes which cause said piston to rotate upon movement of said piston toward said top dead center position, said substantially annular portion being positioned between said second head and said plurality of vanes.

2. The free piston internal combustion engine of claim 1, wherein said second cylinder comprises a compression cylinder and said second head comprises a compression head.

3. The free piston internal combustion engine of claim 1, wherein a radial clearance exists between said compression head and said compression cylinder when said compression head is near said top dead center position, said radial clearance allowing fluid flow past said compression head during the compression stroke.

4. The free piston internal combustion engine of claim 1, wherein said plurality of vanes comprise a plurality of radially extending vanes.

5. The free piston internal combustion engine of claim 4, wherein said plunger rod has a longitudinal axis and said vanes are disposed at an acute angle relative to said longitudinal axis.

6. The free piston internal combustion engine of claim 4, wherein said plurality of vanes have one of a linear and curvilinear profile.

7. A free piston internal combustion engine, comprising:

a housing including a combustion cylinder, a second cylinder, and a fluid port disposed in communication with said second cylinder for transporting a pressurized fluid into said second cylinder; and a piston within said housing which is movable between a top dead center position and a bottom dead center position, said piston including:

a piston head reciprocally disposed within said combustion cylinder;

a second head reciprocally disposed within said second cylinder;

a plunger rod with a first end attached to said piston head and a second end attached to said second head; and a flow impingement device adjacent said plunger rod and attached to at least one of said plunger rod and said second head, said flow impingement device including a plurality of vanes which cause said piston to rotate upon movement of said piston toward said top dead center position, said plurality of vanes comprising a plurality of radially extending vanes, said plurality of vanes having a curvilinear profile.

8. The free piston internal combustion engine of claim 1, wherein said housing further includes a hydraulic cylinder and said piston further includes a plunger head reciprocally disposed within said hydraulic cylinder, said compression head disposed between said piston head and said plunger head.

9. A free piston internal combustion engine, comprising:

a housing including a combustion cylinder and a second cylinder; and a piston including:

a piston head reciprocally disposed within said combustion cylinder;

a second head reciprocally disposed within said second cylinder;

a plunger rod with a first end attached to said piston head and a second end attached to said second head, said plunger rod having a longitudinal axis;

a plurality of radially extending vanes attached to said plunger rod, said plurality of radially extending vanes facing toward said piston head and being disposed at an acute angle relative to said longitudinal axis; and a smooth, substantially annular portion positioned between said second head and said plurality of radially extending vanes, said substantially annular portion being attached to each of said second head and said plurality of radially extending vanes.

10. The free piston internal combustion engine of claim 9, wherein said plurality of vanes have one of a linear and curvilinear profile.

11. A free piston internal combustion engine, comprising:

a housing including a combustion cylinder and a second cylinder; and a piston including:

a piston head reciprocally disposed within said combustion cylinder;

a second head reciprocally disposed within said second cylinder;

a plunger rod with a first end attached to said piston head and a second end attached to said second head, said plunger rod having a longitudinal axis; and a plurality of radially extending vanes attached to each of said plunger rod and said second head, said plurality of radially extending vanes facing toward said piston head and being disposed at an acute angle relative to said longitudinal axis, said plurality of radially extending vanes having a curvilinear profile.

12. The free piston internal combustion engine of claim 9, wherein said housing further includes a hydraulic cylinder and said piston further includes a plunger head reciprocally disposed within said hydraulic cylinder, said compression head disposed between said piston head and said plunger head.

13. The free piston internal combustion engine of claim 1, said flow impingement device having a device diameter and said second head having a head diameter, said device diameter being greater than said head diameter.

* * * * *